US005666600A

United States Patent [19]

Kamprath et al.

[11] Patent Number: 5,666,600

[45] Date of Patent: Sep. 9, 1997

[54] MANDREL WITH A RETRACTABLE SEGMENT FOR MOUNTING A BELT PHOTORECEPTOR ON THE MANDREL

[75] Inventors: David R. Kamprath, Webster; William Brant, Rochester, both of N.Y.

[73] Assignee: Xerox Corporation, Stamford, Conn.

[21] Appl. No.: 586,475

[22] Filed: Jan. 11, 1996

[51] Int. Cl.[6] ..... G03G 21/00

[52] U.S. Cl. ..... 399/165; 101/415.1; 198/813

[58] Field of Search ..... 355/211, 212; 101/415.1, 409; 198/813, 814, 815, 816, 782, 781.02; 474/101; 399/162, 164, 165, 159, 116

[56] References Cited

U.S. PATENT DOCUMENTS

| | | | |
|---|---|---|---|
| 4,183,652 | 1/1980 | Yanagawa | 355/211 |
| 4,357,093 | 11/1982 | Caudill et al. | 355/200 |
| 4,651,643 | 3/1987 | Katz et al. | 101/375 |
| 5,021,829 | 6/1991 | Johnson et al. | 355/213 |
| 5,386,273 | 1/1995 | Wood et al. | 355/212 |

FOREIGN PATENT DOCUMENTS

| | | |
|---|---|---|
| 1432203 | 4/1976 | United Kingdom . |

*Primary Examiner*—Nestor R. Ramirez
*Attorney, Agent, or Firm*—William A. Henry, II

[57] ABSTRACT

A photoreceptor apparatus constructed of a photoreceptor belt releasably attached to the surface of a cylindrical mandrel. The photoreceptor belt is preferably attached to the mandrel by means of a movable segment of the mandrel that is retracted into the mandrel to allow installation of the belt by reducing the effective circumference of the mandrel.

4 Claims, 3 Drawing Sheets

MANDREL WITH A RETRACTABLE SEGMENT FOR MOUNTING A BELT PHOTORECEPTOR ON THE MANDREL

BACKGROUND OF THE INVENTION

1. Field of the Invention

This invention relates to photoreceptors for electrophotographic printing. Particularly, this invention relates to a photoreceptor belt in combination with a cylindrical mandrel. More particularly, this invention relates to a photoreceptor belt removably attached to a cylindrical mandrel by interference fit.

The photoreceptor design of the invention is particularly well suited to replace the current belt or drum photoreceptor designs of electrophotographic printing machines. The current invention will extend the life of the photoreceptor, increase ease of replacement, and reduce the number of complex parts required in a photoreceptor assembly.

2. Description of the Art

In an electrophotographic mono-color printing machine, a photoconductive member is charged to a substantially uniform potential. The charged portion of the photoconductive member is exposed to a light reflected original document image. Exposure of the charged photoconductive member selectively dissipates the charge in the irradiated areas. This records an electrostatic latent image on the photoconductive member corresponding to the informational areas contained within the original document being reproduced. After the electrostatic latent image is recorded on the photoconductive member, the latent image is developed by bringing it into contact with toner. The toner image on the photoconductive member is subsequently transferred to a copy sheet. The copy sheet is heated to permanently affix the toner image. Multicolor electrophotographic printing is substantially identical, although more complex than the mono-color printing process. Cyclic and tandem color copying processes dominate the art of color printing.

In a cyclic multicolor printing process, successive latent images corresponding to different colors are recorded on the photoconductive member during each cycle. Accordingly, one photoconductive member is required in this type of machine. The photoconductive member is used repetitively for each color/cycle. Each single color electrostatic latent image is developed with toner of a color complementary thereto. This process repeated a plurality of cycles for the difference colors in an image and the respective complementary color tone. Each single color toner image is transferred to the copy sheet and superimposed with the prior toner image This creates a multilayered toner image on the copy sheet. Thereafter, the multilayered toner image is permanently affixed to the copy sheet creating a color copy. The primary attributes of a cyclic printing machine are its relatively low number of parts and its low cost. U.S. Pat. No. 4,583,991, herein incorporated by reference, describes a cyclic printing machine in which a sheet moves in recirculated path and successive color toner images are transferred thereto.

A typical tandem printing machine uses multiple printing engines to transfer, in one cycle, different colored toner images directly to a sheet or to an intermediate for subsequent transfer to the sheet. Printing rate is the primary advantage of a tandem machine since all colors are printed in one cycle. However, the complex equipment of a tandem machine leads to a higher cost.

U.S. Pat. Nos. 4,796,050 and 4,803,518, herein incorporated by reference, disclose tandem printing machines having a plurality of photoconductive drums arranged such that color separated light images of an original document are recorded thereon as electrostatic latent images. The latent images are developed into visible color images. A conveyor advances a sheet past each photoconductive drum. Visible color images are transferred from each photoconductive drum to the sheet.

Both cyclic and tandem printing machines can use drum or belt type photoreceptors. Problems are encountered in the use of photoconductive belts because of their reliability, the life of the belt modules, and their difficulty of replacement. In addition, belt modules often experience inboard/outboard travel or even travel in the direction of paper flow. Drum photoconductors are troublesome because of their high cost and their difficulty to replace.

PRIOR ART

U.S. Pat. 5,386,273 discloses a photoreceptor apparatus constructed of a photoreceptor belt releasably attached to the surface of a cylindrical mandrel. The photoreceptor belt is attached to the mandrel by means of a slot in the mandrel capable of accepting a portion of the belt and retained therein by means of a releasable key.

A multicolor image forming apparatus that includes an imaging drum is disclosed in U.S. Pat. 5,021,829. A photoconductive sheet secured to the drum by clamping means in a trough or gap in the drum

SUMMARY OF THE INVENTION

Accordingly, it is a primary object of this invention to provide a new and improved photoreceptor mounting apparatus.

It is a further object of this invention to provide a new and improved mandrel from which a photoreceptor can be easily removed and replaced.

Additional objects and advantages of the invention will be set forth in part in the description which follows and a part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the photoreceptor of this invention comprises a cylindrical mandrel having a photoreceptor belt attached thereto. Attached as used herein means the photoreceptor belt is substantially fixed in a place on the full circumference of the mandrel at the longitudinal surface by interference fit. Preferably, the means for attaching the belt to the mandrel comprises a retractable segment mechanism that isolated against the photoreceptor belt to hold the photoreceptor belt in place. Preferably, the photoreceptor belt is a multilayered continuous belt.

In one embodiment, the mandrel includes a retractable segment mechanism and at least two springs. The springs bias against an end portion of the retractable segment mechanism in order to position the segment mechanism in a predetermined location with respect to the outer surface of the mandrel. The spring force is large enough to overcome the belt tension resulting from interference between the belt and the mandrel. Belt tension is controlled by the level of interference between the belt and mandrel.

Another embodiment of the retractable segment mechanism of the present invention includes a double acting cam actuation device that is rotated either clockwise in order to engage a belt that is mounted on a mandrel or counterclockwise to disengage from the belt to facilitate simple and easy removal of the belt from the mandrel.

The photoreceptor of the current invention is utilizable as a replacement for previously known photoreceptor drums in printing machines, for example U.S. Pat. No. 5,121,171, herein incorporated by reference.

The photoreceptor belt in the current invention can be any type. U.S. Pat. No. 4,265,990, describes acceptable photoreceptors.

BRIEF DESCRIPTION OF THE DRAWINGS

The invention consists in the novel parts, construction, arrangements, combinations and improvements shown as described. The accompanying drawings, which are incorporated in and constitute a part of the specification illustrate one embodiment of the invention and, together with the description, serve to explain the principles of the invention.

DETAILED DESCRIPTION OF THE INVENTION

Reference will now be made in detail to the present preferred embodiment of the invention, an example of which is illustrated in the accompanying drawings.

While the invention will be described in connection with a preferred embodiment, it will be understood that it is not intended to limit the invention to that embodiment. On the contrary, it is intended to cover all alternatives, modifications and equivalents as may be included within the spirit and scope of the invention defined by the appended claims.

Figure 1:
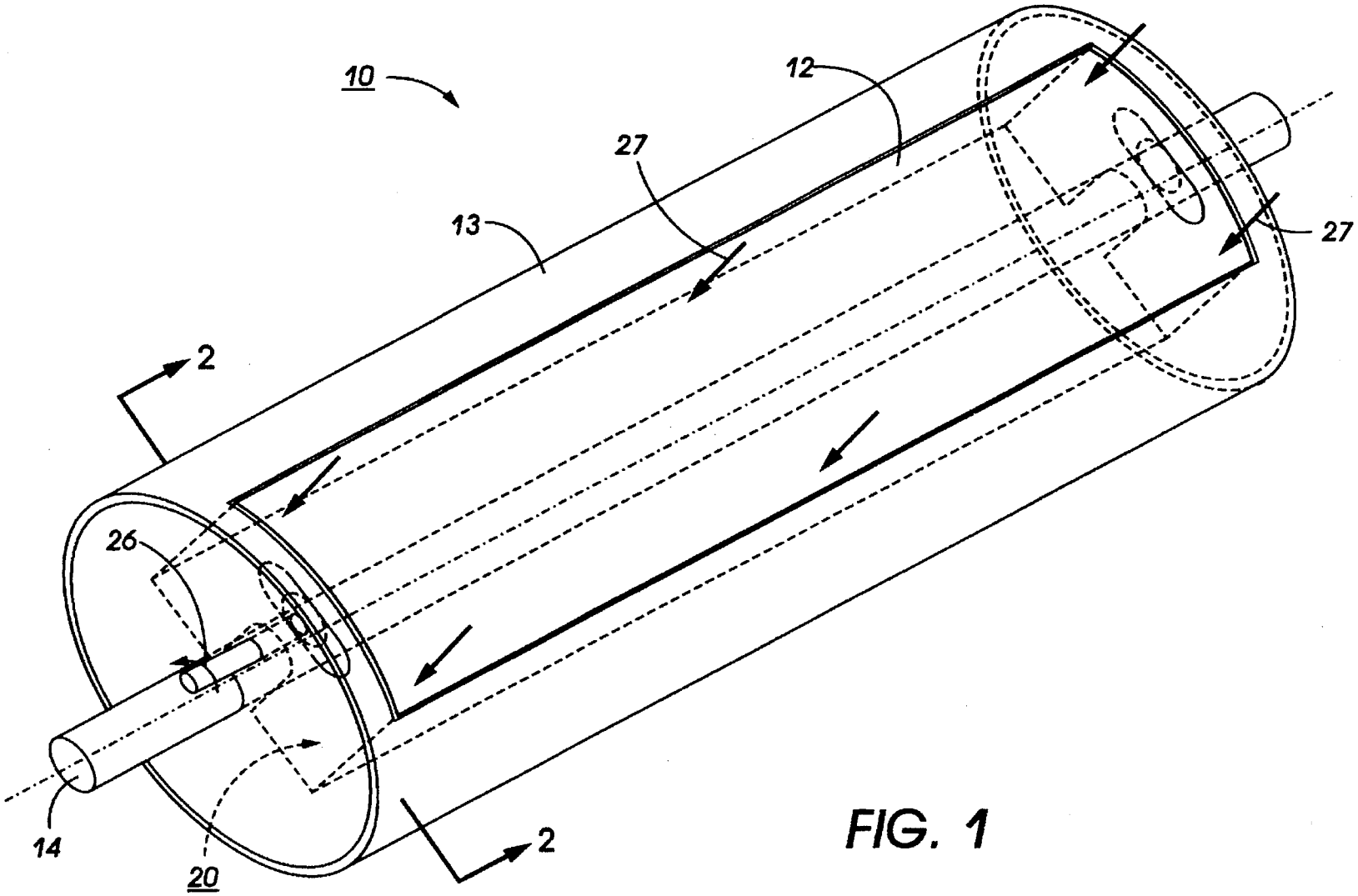
FIG. 1 is an isometric view of a belt photoreceptor mounted on a mandrel with the preferable retractable segment mechanism of the present invention as part of the mandrel.

Referring now to the drawings and FIG. 1, a cylindrical mandrel 10 is shown having a surface 12 about which photoreceptor belt 13 can be snugly mounted. The mandrel is mounted on shaft 14 at opposite ends thereof. Typically, xerographic machines are designed with photoreceptors in one of two alternative geometries: drum or belt module. Belt modules provide distinct advantages in the interface flexibility, amount of surface (pitches) feasible, and the consumable cost of the belt itself. Drums provide improved motion quality, reduced machine cost, and a seamless photoreceptor. Also, manufacturing capabilities favor belts. Some of the key benefits of the belt and the drum may be captured by mounting a belt in a xerographic machine such that it operates like a drum. The combination of a belt with a drum in accordance with the present invention will be referred to herein as DRELT (DRum bELT). The challenge involved in implementing such a system include: a) making the belt easy to replace; b) achieving the tight tolerances required; and c) maintaining the machine cost advantage of a drum.

Figure 2:
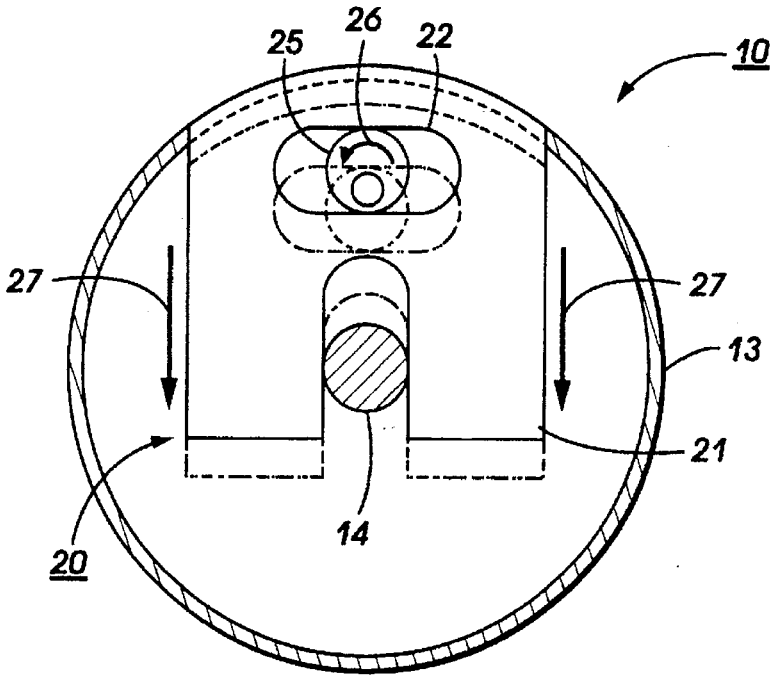
FIG. 2 is an end view of the mandrel of FIG. 1 showing the retractable segment mechanism of the present invention.

As shown more clearly in FIG.2, this marriage of photoreceptor belt 13 and mandrel 10 is accomplished by making mandrel 10 include a retractable segment mechanism 20 that is machined as an assembly. Retractable segment mechanism 20 includes identical portions at opposite ends of the mandrel and comprises a movable portion 21 having an oval shaped hole 22 in the center thereof. A double acting cam 25 is mounted in the oval shaped hole 22 and adapted to be turned by a person while in the act of putting the photoreceptor belt 13 on mandrel 10 or taking the photoreceptor off the mandrel. When changing belt 13 is necessary, one simply rotates cam member 25 in a counterclockwise direction as indicated by arrow 26 and movable portion 21 of retractable segment mechanism 20 is moved in the direction of arrows 27 to the position shown in dotted lines which effectively reduces the circumference of the mandrel thereby making it a easy task to remove the photoreceptor belt from mandrel 10. Replacing the photoreceptor is an easy accomplishment as well and involves inserting a photoreceptor belt over the mandrel while it is retracted and rotating cam member 25 in a clockwise direction to move the movable segment portion 21 of mandrel 10 up to a point even with the surface 12 of the mandrel to create an interference fit between the photoreceptor belt and mandrel 10. Thusly, a photoreceptor can then be removed from the mandrel with ease and replaced with another photoreceptor with ease.

The mandrel 10 with retractable segment mechanism 20 is machined as an assembly. This makes for a simple turning operation of cam member 25 to install photoreceptor belt 13 onto mandrel 10 with an interference fit or remove photoreceptor belt 13 from the outer surface of the mandrel. The interference fit is designed to accommodate manufacturing tolerances of both the mandrel and the belt, as well as, relative expansion due to temperature and humidity. The limiting conditions considered are belt to mandrel pressure required for belt drive and stress damage limits of the belt.

Figure 3:
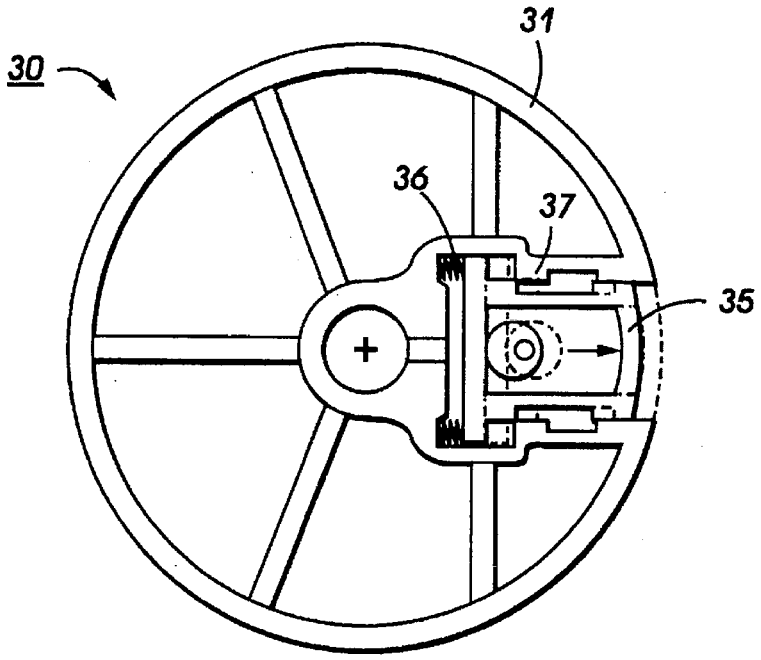
FIG. 3 is an alternative mandrel arrangement showing a different retractable segment mechanism of the present invention.

An alternative DRELT embodiment of the present invention in FIG. 3 comprises a mandrel 30 with a movable segment portion 35 that is loaded by springs 36 against shoulders 37 of mandrel 30. Mandrel 30 includes an outer surface 31 and springs 36 which bias movable segment portion 35 such that the outer surface of the movable segment portion is in the same plane as surface 31 of the mandrel in order to provide interference fit between both outer surfaces and a belt mounted on the mandrel. The belt is removed from the mandrel by simply pressing movable segment inward against the bias of springs 36 to a point below surface 31 of mandrel 30 to remove the interference fit between the mandrel and the belt and removing the the belt. Placing a belt onto mandrel 30 is accomplished by biasing movable segment portion 35 against springs 36 and inserting the belt over the outer surface 31 of the mandrel. Once the belt is in position, the movable segment portion is released and pressed by springs 36 into its original position against the belt. The belt is maintained in contact with outer surface 31 of mandrel 30 due to an interference fit between the two.

Figure 4:
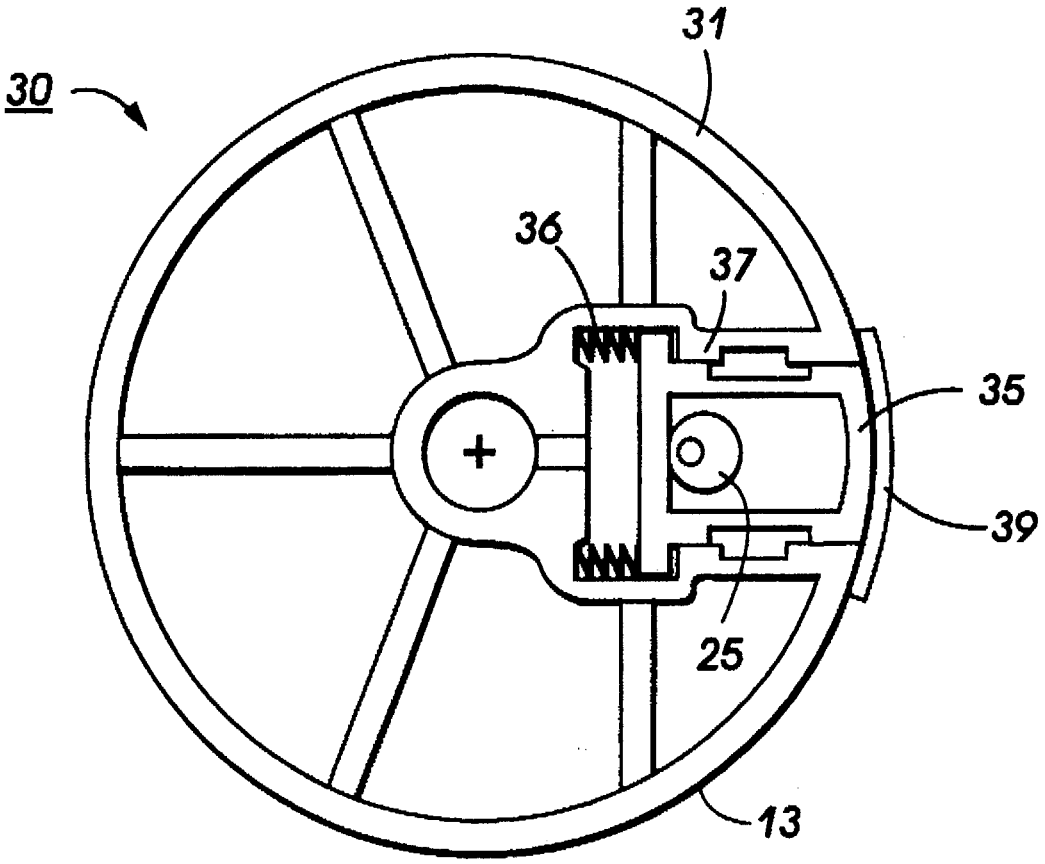
FIG. 4 is yet another alternative mandrel arrangement showing a different retractable segment mechanism that works in conjunction with a ledge to prevent movement of a photoreceptor belt in accordance with the present invention.

In FIG. 4, yet another alternative embodiment of the present invention is shown that includes all of the elements of FIG. 3 with the addition of ledge member 39 which is used to clamp photoreceptor 13 to the outer surface 31 of mandrel 30. The photoreceptor slides under ledge and is held against the under surface of ledge member 39 by segment portion 35 that is biased thereagainst through springs 36. This mechanism prevents migration of photoreceptor 13 on surface 31 of mandrel 30.

The photoreceptor mounting method and apparatus of FIGS. 1–4 are such that they facilitate flexible photoreceptor belts acting like photoreceptor drums. This provides the consumable cost and manufacturing capacity advantages of belts with the motion quality and machine cost advantages of drums. In essence, a mandrel is configured with an interference fit relative to a photoreceptor belt to hold the photoreceptor belt in place and provide shape in FIGS. 1–3. A small portion of the mandrel is designed as a movable segment which is retracted into the mandrel to allow installation of a photoreceptor belt onto the mandrel by reducing the effective circumference of the mandrel. A ledge member of clamp holds a photoreceptor in place in FIG. 4.

It should now be understood that a DRELT system has been provided and, in accordance with the invention, includes a method and apparatus for mounting a flexible photoreceptor belt on a cylindrical mandrel with a retractable segment that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having thus described the invention, it is claimed:

1. A photoreceptor apparatus, comprising:

a flexible photoreceptor belt;

a cylindrical mandrel on which photoreceptor belt is to be mounted, said mandrel including a retractable segment, and wherein said retractable segment is adapted to be moved to a retracted position when said photoreceptor belt is placed onto and removed from said mandrel and moved to a non-retracted position to provide interference fit between said mandrel and said photoreceptor while said photoreceptor is mounted on said mandrel, said mandrel and said retractable segment being machined as an assembly; and wherein said retractable segment includes a rotatable cam member, and wherein rotation of said cam member in a first direction relieves said interference fit between said mandrel and photoreceptor belt and rotation of said cam member in a second direction provides said interference fit between said mandrel and photoreceptor belt.

2. An apparatus that facilitates the mounting and dismounting of a flexible photoreceptor belt with respect to a support, comprising:

a flexible photoreceptor belt;

a cylindrical mandrel onto which said photoreceptor belt is to be mounted and dismounted, said mandrel including a spring biased movable segment that is adapted to be moved in a first direction in order to mount said photoreceptor belt onto said mandrel and moved in a second and opposite direction in order to remove said photoreceptor belt from said mandrel; and wherein said movable segment includes a rotatable cam member, and wherein rotation of said cam member in a first direction relieves an interference fit between said mandrel and photoreceptor belt and rotation of said cam member in a second direction provides said interference fit between said mandrel and photoreceptor belt.

3. An apparatus that promotes ease in supporting and removing a photoreceptor belt from a surface, comprising:

a cylindrical mandrel, said cylinder mandrel including a multi-positionable movable segment adapted to be moved into a first position in order to facilitate removal of said photoreceptor belt from said mandrel and spring biased into a second position in order to secure said photoreceptor belt onto said mandrel; and wherein said movable segment includes a rotatable cam member, and wherein rotation of said cam member in a first direction relieves an interference fit between said mandrel and photoreceptor belt and rotation of said cam member in a second and opposite direction provides said interference fit between said mandrel and photoreceptor belt.

4. A method for mounting a flexible photoreceptor belt on a rigid cylinder, comprising the steps of:

a) providing a cylindrical mandrel with a movable segment as a part thereof;

b) providing a flexible photoreceptor belt;

c) moving said movable segment of said mandrel in a first direction;

d) placing said photoreceptor belt onto said cylindrical mandrel;

e) moving said movable segment in a second direction to provide interference fit between said mandrel and said photoreceptor belt; and f) moving said segment by use of a rotatable cam member.

* * * * *